US005584735A

United States Patent [19]

McMath

[11] Patent Number: 5,584,735

[45] Date of Patent: Dec. 17, 1996

[54] WARM WATER SUPPLY SYSTEM

[76] Inventor: John W. McMath, 2430 Colonel Court Dr., Richmond, Tex. 77469

[21] Appl. No.: 590,094

[22] Filed: Jan. 24, 1996

[51] Int. Cl.[6] ..... B63H 21/10

[52] U.S. Cl. ..... 440/88; 4/598

[58] Field of Search ..... 440/88, 89; 114/270; 4/597, 598

[56] References Cited

U.S. PATENT DOCUMENTS

| | | | |
|---|---|---|---|
| 1,684,900 | 9/1928 | Waters . | |
| 2,894,265 | 7/1959 | Reardon | 4/598 |
| 3,381,316 | 5/1968 | Anderson | 4/597 |
| 3,568,209 | 3/1971 | O'Neill et al. . | |
| 4,067,064 | 1/1978 | Cerniway et al. . | |
| 4,457,295 | 7/1984 | Roehr . | |
| 5,100,261 | 3/1992 | Plemon | 405/186 |
| 5,299,329 | 4/1994 | Constantini | 4/598 |
| 5,429,534 | 7/1995 | Cano | 440/88 |

*Primary Examiner*—Jesus D. Sotelo
*Attorney, Agent, or Firm*—Gunn & Associates, PC

[57] ABSTRACT

An apparatus and method for supplying temperate water from a water cooled internal combustion engine to warm outdoor water enthusiasts during cool weather, said engine generally having a cooling system with an intake, a cool water pump with a discharge to supply cool water to the cooling system and a warm water pump having a discharge to circulate water in the cooling system, said apparatus and method comprising a warm water supply line connected to the discharge side of the circulating pump in the engine cooling system, a cool water supply line connected between the cool water pump discharge and the engine cooling system intake, the cool water supply line and the warm water supply line feeding into a Y-connection and delivery line having a shower head or other water distribution apparatus at the opposite end for warming, for example, a water skier; valves in the warm water supply line and cold water supply line control the flow of water in each line; a valve in the shower head regulates the volume of water delivered to the shower head; a quick disconnect fitting with a shutoff valve at the Y-connection allows storage of the delivery line when not in use; and a valve in the delivery line before the shower head allows flow in the delivery line to be shut off so the shower head can be disconnected while the engine is running.

52 Claims, 2 Drawing Sheets

WARM WATER SUPPLY SYSTEM

FIELD OF THE INVENTION

This invention relates to warm water sources of water for outdoor recreational activities, and more particularly, to showers which connect to and use fluid from the cooling system of an internal combustion engine without the need for an additional electric pump to warm a water skier in cool weather.

BACKGROUND OF THE INVENTION

Outdoor water sports are curtailed during much of the year due to cool weather. Skiers and divers become chilled even with the use of wet suits. A device which supplies hot water to a water skier for a warm shower or bath in cooler weather allows a skier to warm up quickly and extends the water skiing season. The only available source of heat is often the internal combustion engine of a boat. However, previous devices using heat from a boat engine have provided insufficient water pressure at engine idle speeds, have required expensive pumps, have required separate heat exchangers, and/or have required complicated electrical/mechanical connections. There is a need for a device which provides a sufficient pressure and volume of hot water for a shower or bath at a controlled temperature from the cooling system of a boat engine at idle with minor engine modification.

The prior art related to the warming of persons engaged in water activities does not lend itself to pleasure craft or simple installation by small boat owners. Prior art systems and devices draw cooling water from the intake side of cool water supply pumps or attempt to operate solely from cooling system hot water circulation pumps. These systems and devices can deprive the engine of cooling water and cause danger of overheating. Often in these systems water pressure varies greatly depending on the speed of the engine. These systems also provide insufficient water volume and pressure at idle. Separate pumps and pressure regulators have been added to correct these problems which increase the expense and complexity of these systems. Often the water volume and temperature of such systems are difficult to control. Such systems are not user friendly for storage or use by non-commercial consumers.

SUMMARY OF THE INVENTION

It is the object of this invention to provide a simple and inexpensive alternative to shower systems which require separate pumps and/or elaborate mechanical installations. It is an object of the invention to provide a system which can be easily attached as an accessory to engines of ski boats by their owners with minimal effort, minimal maintenance and maximum assurance of reliability and safety. It is the object of this invention to provide sufficient pressure and volume of heated water from the existing engine cooling system of a boat at engine idle speeds without the use of an electric pump or danger of damage to the engine. It is further the object of the invention to allow regulation of the mixed water temperature separately from regulation of the mixed water volume for greater ease of use and greater comfort of the user. It is further the object of this invention to provide a system in which on deck water delivery lines can be disconnected and stored for convenience between use.

This invention provides a warm water supply line of ½" ID tubing which connects to the cooling system drain port on the engine block. There is a cool water supply line of substantially ⅝" diameter which connects to the discharge hose of the cool water supply pump. The use of substantially ⅝" tubing for the cool water supply line is necessary to overcome low pressure in cool water pumps supplied by manufacturers on many boats. The use of smaller diameter lines causes insufficient pressure and volume of cool water in many systems. In practice, a preassembled cool water supply line, connection and discharge hose are provided to insure a secure connection to the cool water supply line to the engine and ease of installation. The cool and warm water lines connect at a Y-connection so the cool and warm water can be mixed in a delivery line. The delivery line has a valve at the other end at a disconnect fitting which allows a shower head or other water distribution apparatus to be attached while the system is under pressure. The Y-connection has valves on each junction and a quick disconnect at the common end. The valves on each fork of the junction allow relative volume of hot and cold water to be controlled to regulate temperature of the mixed water stream. The valve on the common end of the Y-connection allows water to be shut off when the delivery line is disconnected for storage. A valve at the shower head allows control of the volume of heated water to the user. Multiple delivery lines may be connected to the common end of the Y-connection, in the delivery line or in the supply lines to allow showers by two or more users simultaneously.

The use of ⅝" ID tubing and a cool water connection point on the discharge side of the cool water supply pump is useful to provide sufficient water pressure and volume at low engine speeds in contrast to systems and methods of other devices. This cool water connection point also minimizes the danger of engine overheating due to lack of cooling water. The use of valves at all points of the system increases user control of water temperature and volume, as well as user satisfaction and storage.

BRIEF DESCRIPTION OF THE DRAWINGS

The invention will be more clearly understood by reference to the description below taken in conjunction with the accompanying drawings wherein.

DETAILED DESCRIPTION OF THE PREFERRED EMBODIMENT

Figure 1:
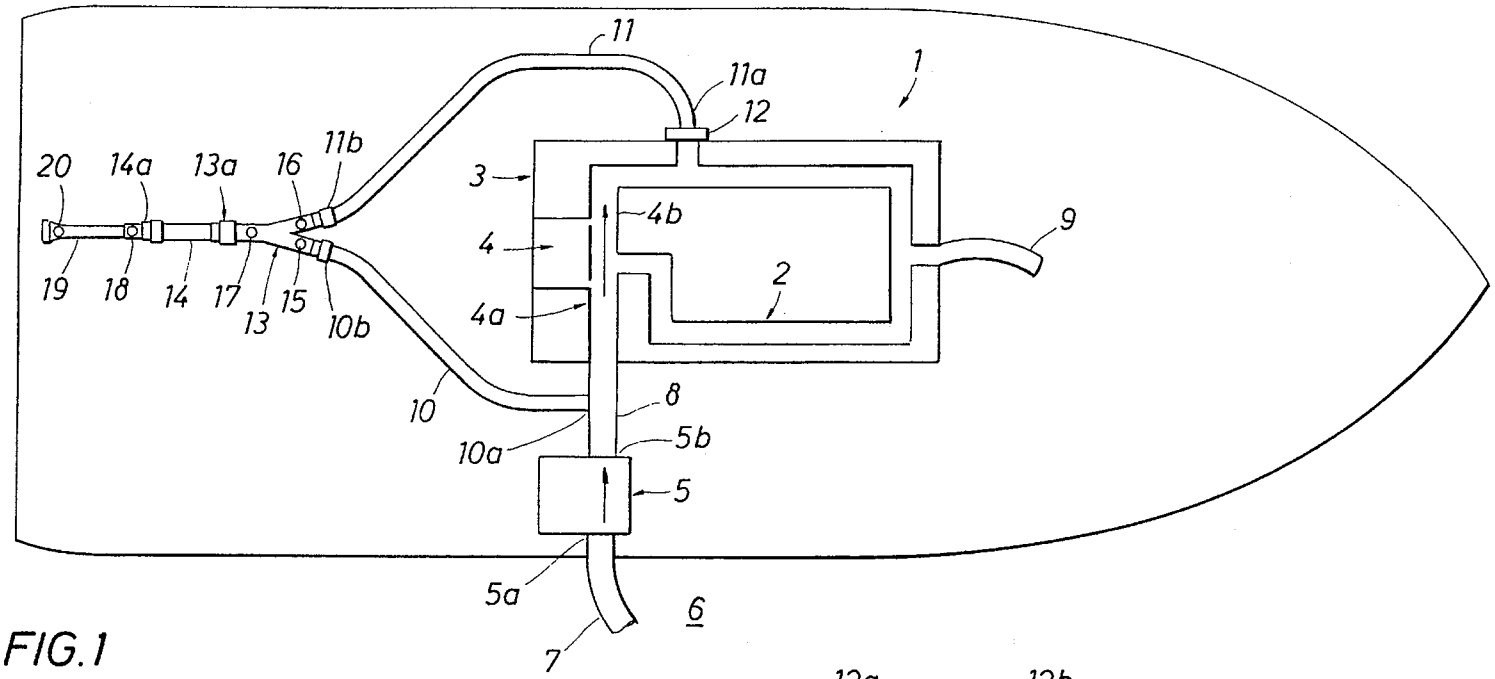
FIG. 1 shows a view of the cool and warm water supply lines as they may be connected to an internal combustion engine in the preferred embodiment.

FIG. 1 presents an internal combustion engine 1 in a configuration which is typical of modern boating installations supplied by boating manufacturers. Such engines 1 typically have a cooling system 2 for cooling the engine block 3, an internal warm water pump 4 for circulating water at discharge port **4*b* in the cooling system 2, and a cool water pump 5 which supplies water to the cooling system 2. The cool water pump 5 and warm water pump 4 are normally mechanically driven by the engine 1**.

The cool water pump 5 picks up water at intake **5*a* from a cool water source 6, typically the body of water floating the boat, in line 7 and discharges it at discharge port 5*b*** in line 8 at a volume and pressure sufficient to supply water at an ambient temperature of the body of water to the intake port 4*a* of the warm water pump 4 and cooling system 2 of engine 1. Water from the ambient cool water source 6 is elevated in temperature to warm or hot water by the engine 1 and engine cooling system 2. Warm water not needed in the cooling system to cool the engine is discharged from the cooling system 2 and engine block 3 at port 9.

The present invention in the preferred embodiment has a cool water supply line 10 and a warm water supply line 11. The warm water supply line 11 preferably connects at point 11*a* to a drain port 12 in the cooling system 2 on the engine block 3 to obtain warm water for use. In the preferred embodiment, the cool water supply line 10 obtains cool water for use at a connection 10*a* to the cool water pump 5 discharge line 8, or at some point between the discharge port 5*b* and the cooling system and warm water pump intake port 4*a*. It is recommended that the entire line 8 between the discharge port 5*b* and the intake port 4*a* with connection point 10*a* be supplied to the consumer as a substitute to the engine's original line 8. This allows ease of installation. It also allows simple removal of the shower apparatus from the engine to restore the engine to original condition by replacement of the original line 8.

Figure 1A:
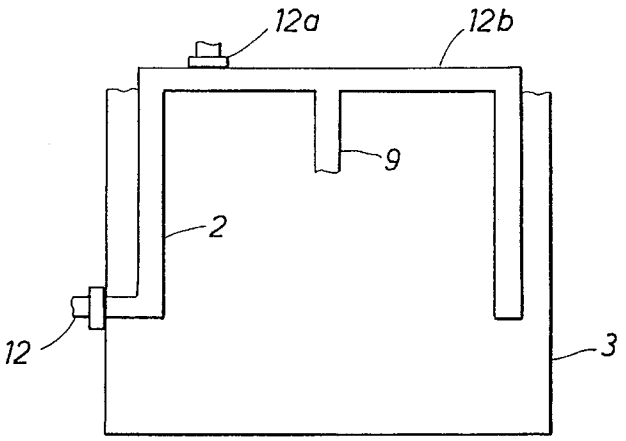
FIG. 1A shows a section view of the engine block from one end with crossover sections of the cooling system.

The use of a drain port 12 in the engine block 3 is significant. Specifically, connection of the warm water supply line to a drain port 12 lower in the cooling system 2 provides a more reliable source of warm cooling system fluid than connection of the warm water supply line 11 to a port 12*a* higher in the system, such as on a crossover manifold 12*b* typically used in an eight cylinder engine block formed in a V shape. Port 12*a* is typically used in an automobile to connect a heater hose for a heating system inside the vehicle. See FIG. 1A. A lower connection point would be a connection point which is lower than a typical V8 engine crossover manifold 12*b* and a connection point which, if opened, would allow a substantial amount of the cooling system fluid to drain from the engine by gravity. A lower connection point such as drain point 12 prevents air in the cooling system from entering the warm water supply line 11 and supplies a greater quantity of warmer water of more uniform temperature. Prior art kits for warm water supply systems obtain warm water from upper portions of the engine cooling system such as from the crossover manifold 12*b* at port 12*a*. This causes considerable variation in the temperature and quantity of warm water supplied to the user, particularly when the delivery line 14 or shower head 20 is raised or lowered by the user during use.

In addition, connection of the warm water supply line 11 to a drain port 12 in the cooling system 2 low on the engine block 3 allows the warm water supply line 11 to be disconnected, for example, at connection 11*b*, and used to drain the engine of engine coolant in freezing weather. This is accomplished by placing the disconnected end of warm water supply line 11 in a lower position than drain port 12, such as in the bilge of the boat, so that cooling system fluid can drain by gravity from the engine block.

Figure 2:
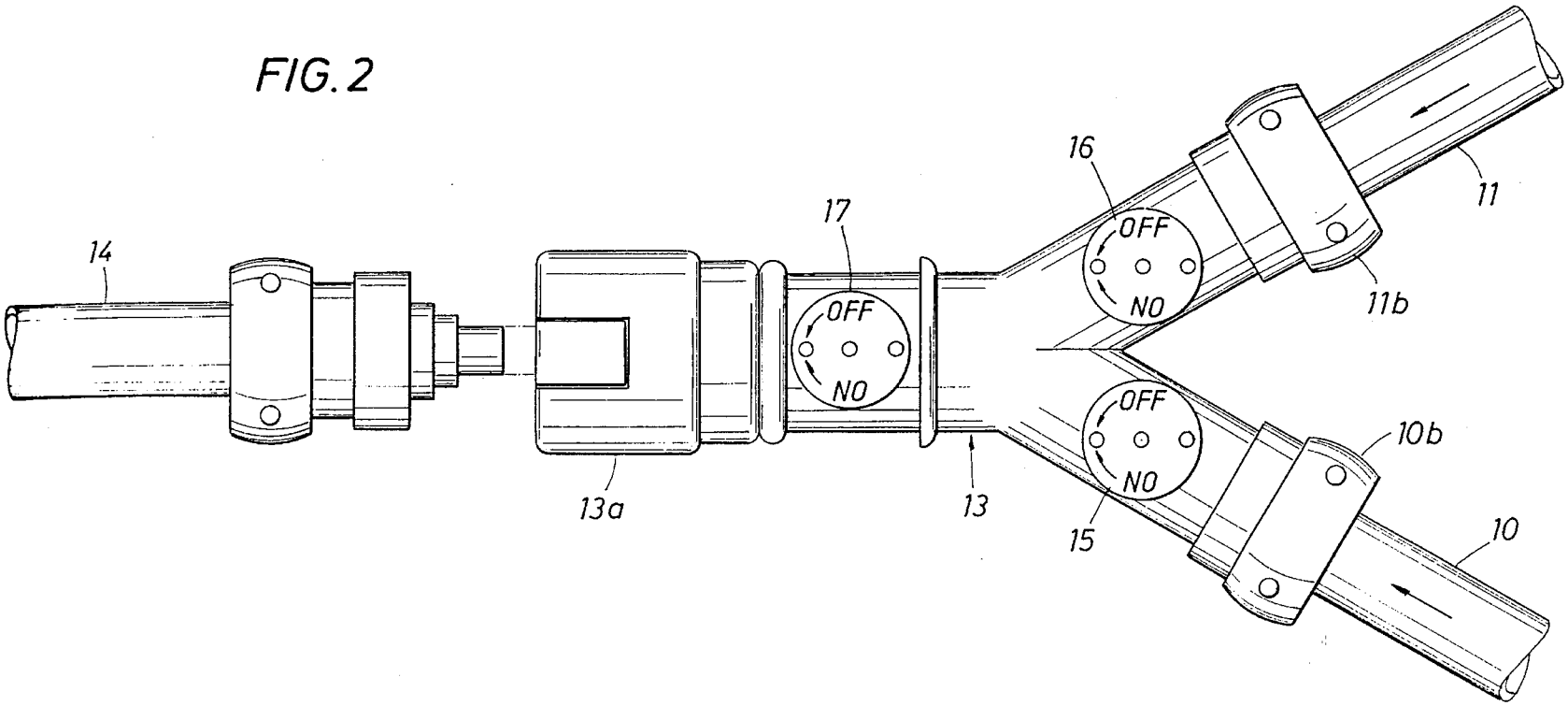
FIG. 2 shows a view of the Y-connection between the warm and cool water supply lines and the delivery line, including valves to regulate flow.

With more detailed reference to FIG. 2, the warm water supply line 10 and cool water supply line 11 have connections 10*b* and 11*b*, respectively, to Y-connection 13 for mixing the warm and cool fluids into a common fluid delivery line 14 connected to the common port 13*a* of Y-connection 13. Valves 15 and 16 control the volume of cool and warm water which flows in the cool water supply line 10 and warm water supply line 11, respectively. Adjustment of valves 15 and 16 control the relative mixing of warm and cold water, and thereby the temperature of the water. Valve 17 at the common port 13*a* of Y-connection 13 controls How of the combined warm and cool fluids. Valve 17 is generally used to turn off flow when delivery line 14 is disconnected at connection port 13*a*. Valves in this arrangement have proven to be particularly convenient for control by the user.

Figure 3:
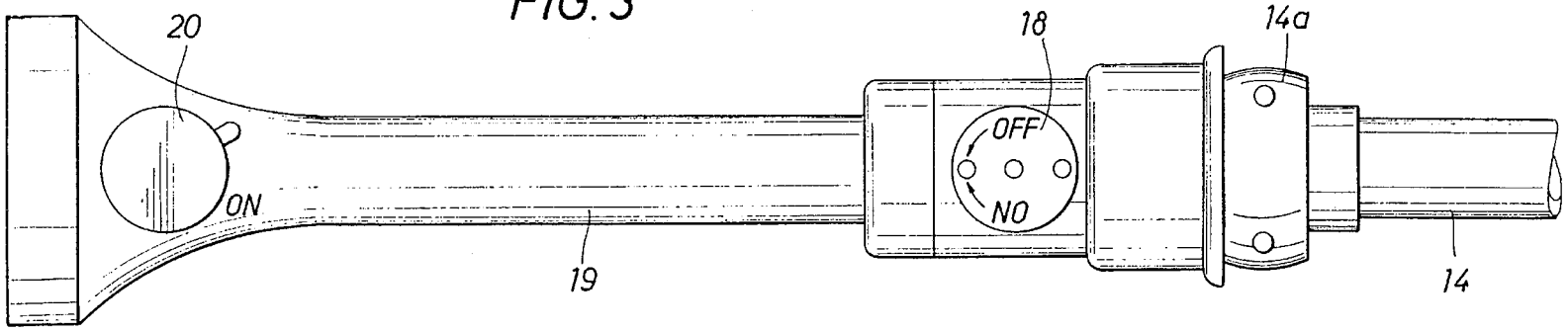
FIG. 3 shows the delivery line connected to a shower head with valves for adjusting flow.

With reference to FIG. 3, the delivery line 14 delivers mixed warm and cool fluid to the user and may be affixed to any type of delivery device such as a shower head 19 at connection 14*a* for end use by a skier, etc. Valve 18 controls How in the delivery line 14 and valve 20 controls flow in the shower head 19. In the preferred embodiment, quick disconnect connections are used for connection points 13*a* and 14*a*. Connection point 13*a* allows the delivery line 14 and shower head 20 to easily be disconnected for deck storage. Connection 14*a* allows the shower head 20 to be replaced with other water delivery devices which may be convenient for the user such as nozzles and the like. Water in the delivery line 14 is conveyed to the user and discharged to the atmosphere or body of water from which it came.

The use of a substantially ⅝" diameter tubing for the cool water supply line 11 is an important factor in the method and system. This size tubing allows sufficient flow, yet prevents turbulent flow in the cool water pump 5 discharge line 8 which may prevent sufficient cooling water from reaching the engine cooling system 2. This limits the danger of overheating of the engine due to shower use or turbulent flow due to the cool water line 11 connection point 10*a*. Similarly, connection of the cool water supply line to the discharge side of the cool water pump 5 further allows sufficient flow of cool water in cool water supply line 10 and to the engine cooling system 2 and warm water pump 4 at port 4*a*. These factors substantially reduce any need for a separate electric pump to supply cool fluid to the user.

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention. This invention should be read broadly in light of the following claims to a warm water shower system.

What is claimed is:

1. A shower kit for conversion of an internal combustion engine on a boat to provide temperate water for cool weather water activities, said engine having a cooling system with cooling system fluid and a cool fluid intake, a cool fluid pump having a discharge to supply cool fluid to the cool fluid intake of the engine and a warm fluid pump having a discharge to circulate fluid in the cooling system, which comprises:

a. a cool fluid line for conveying cool fluids from the engine to the user;

b. a first connection means for connecting one portion of the cool fluid line to the internal combustion engine between the cool water pump discharge and the cool water intake of the engine;

c. a warm fluid line for conveying warm fluids from the engine for use; and d. a second connection means for obtaining warm fluid from the engine in one portion of the warm fluid line at a point after cooling system fluid is discharged from the warm water pump.

2. The shower kit of claim 1 which further comprises a third connect means for connecting the warm fluid line and the cool fluid line so that the warm and cool fluids are mixed prior to delivery for use.

3. The shower kit of claim 2 which further comprises a first valve means of regulating the volume and temperature of fluid flow for use.

4. The shower kit of claim 3 in which the first valve means further comprises a delivery valve which regulates the flow of mixed warm and cool fluids.

5. The shower kit of claim 4 in which the cool fluid line has a volume of flow at least equal to ⅝ inch diameter tubing.

6. The shower kit of claim 5 in which the second connection means is connected to the cooling system at a point which would allow a substantial portion of the fluid in the cooling system to drain by gravity if opened.

7. The shower kit of claim 6 in which the second connection means connects the warm fluid line to a cooling system drain port on the engine.

8. The shower kit of claim 6 which further comprises a first valve means for regulating the relative temperature of fluid flow for use comprising a cool valve which regulates the volume of fluid flow in the cool fluid line and a warm valve which regulates the volume of fluid flow in the warm fluid line.

9. The shower kit of claim 8 which further comprises a first valve means of regulating the volume and temperature of fluid flow for use comprising a cool valve which regulates the volume of fluid in the cool fluid line, a warm valve which regulates the volume of fluid in the warm fluid line, and a delivery valve which regulates the flow of mixed warm and cool fluids.

10. The shower kit of claim 9 which further comprises:

a. a delivery means for delivering mixed warm and cool fluids to the user; and b. a disconnect means for disengaging the delivery means for storage.

11. The shower kit of claim 10 in which the delivery means further comprises:

a. a first delivery means for delivering fluids for a first use;

b. a second delivery means for delivering warm and cool fluids for a second separate use.

12. The shower kit of claim 2 which further comprises a temperature regulation shutoff means for controlling the temperature of mixed warm and cool fluids as well as for controlling the volume of mixed warm and cool fluids.

13. The shower kit of claim 12 in which:

a. the temperature regulation and shutoff means for controlling the temperature of mixed warm and cool fluids comprises a cool valve which controls the flow of cool fluids in the cool fluid line and a warm valve which controls the flow of warm fluids in the warm fluid line; and b. the temperature regulation and shutoff means for controlling the volume of mixed warm and cool fluids is a delivery valve which controls the flow of mixed warm and cool fluids.

14. An apparatus for providing temperate water for use in cool weather water activities from an internal combustion engine, said engine having a cooling system, a warm fluid pump with a discharge to circulate fluid in the cooling system and a cool fluid pump with a discharge to supply cool fluid to the cooling system, comprising:

a. a cool fluid supply means which obtains cool fluid after the cool fluid is discharged from the cool fluid pump and conveys the cool fluid for use; and b. a warm fluid supply means which obtains warm fluid from the cooling system after the warm fluid is discharged from the warm fluid pump and conveys the warm fluid for use.

15. The apparatus of claim 14 which further comprises a cool fluid supply means and warm fluid supply means which discharge the cool fluid and warm fluid to the atmosphere.

16. The apparatus of claim 15 which further comprises a first delivery means connected to the cold fluid supply means and the warm fluid supply means for combining the cool and warm fluids and conveying the fluids for use.

17. The apparatus of claim 16 which further comprises:

a. cool valve means for regulating the volume of fluid flow in the cool fluid supply means; and b. warm valve means for regulating the volume of fluid flow in the warm fluid supply means.

18. The apparatus of claim 17 which further comprises a delivery valve means which regulates the volume of fluid flow in the first delivery means.

19. The apparatus of claim 18 which further comprises a connection of the cool fluid supply means and the warm fluid supply means which is disengageable with the delivery means so that the delivery means can be separated from the cool fluid supply means and the warm fluid supply for storage.

20. The apparatus of claim 19 which further comprises a cool fluid supply means which allows a volume of flow at least substantially equal to ⅝" ID tubing.

21. The apparatus of claim 20 which further comprises a second delivery means connected to convey warm and cool fluid for separate and simultaneous use from the first delivery means.

22. The apparatus of claim 19 in which the warm fluid supply means is connected to the cooling system at a point which would allow a substantial portion of the fluid in the cooling system to drain from the cooling system by gravity if opened.

23. The apparatus of claim 22 in which warm supply means is connected to the cooling system at a cooling system drain port on the engine.

24. A method of providing temperate fluid from an internal combustion engine on a boat for use during cool weather water activities, said engine having a fluid cooling system with a fluid intake, a cool fluid pump having a discharge to supply cool fluid to the cooling system and a warm fluid pump to circulate fluid through the cooling system, comprising:

a. connecting a portion of a cool fluid supply line between the discharge of the cool water pump and the intake of the cooling system;

b. obtaining warm fluid from the cooling system for a warm fluid supply line; and c. regulating the flow of fluids in the warm and cold fluid supply lines.

25. The method of claim 24 further comprising:

a. discharging the cool fluid and warm fluid outside the cooling system; and b. combining the fluids in the cool fluid supply line and the warm fluid supply line into a delivery line.

26. The method of claim 25 further comprising:

a. regulating the flow in the cool fluid supply line to control volume of flow and water temperature in the delivery line; and b. regulating the flow in the warm fluid supply line to control volume of flow and water temperature in the delivery line.

27. The method of claim 26 further comprising regulating the flow in the delivery line for convenience of the user.

28. The method of claim 27 further comprising disengageably connecting the delivery line to the cool fluid supply line and the warm fluid supply line for purposes of storage.

29. The method of claim 28 further comprising combining the fluids in the cool fluid supply line and the warm fluid supply line into more than one delivery line so cool and warm fluids can be used for more than one purpose simultaneously.

30. The method of claim 29 further comprising obtaining warm fluid from the cooling system for the warm fluid supply line by connecting the warm fluid supply line to the cooling system at a point which would allow a substantial portion of the fluid in the cooling system to drain by gravity if opened.

31. The method of claim 30 in which the warm fluid supply line is connected to the cooling system at a cooling system drain port.

32. The method of claim 30 further comprising providing a cool fluid supply line which conveys a volume of fluid substantially equal to ⅝" diameter tubing.

33. The method of claim 32 further comprising regulating flow at the desengagable connection to the delivery line so that the flow may be shut off when the delivery line is disconnected.

34. The method of claim 33 further comprising connecting a shower head to the delivery line.

35. The method of claim 34 further comprising regulating flow in the shower head for convenience of the user.

36. The method of claim 35 further comprising disengagably connecting the shower head to the delivery line.

37. The method of claim 36 further comprising regulating flow at the disenagable connection of the shower head so flow can be shut off in the delivery line when the shower head is disconnected.

38. A pumpless warm water system for installation on an internal combustion engine on a boat floated in a body of water which supplies engine coolant water for end use by outdoor sports enthusiasts in cool weather, said engine having a cool water pump with a discharge to supply engine coolant from the body of water, an engine cooling system utilizing water, and a warm water pump with a discharge to circulate engine coolant in the cooling system, which comprises:

a. a means for utilizing engine coolant water for end use;

b. a means for obtaining a first supply of engine coolant water at an ambient temperature from the body of water after it is discharged from the cool water pump; and c. a means for obtaining a second supply of engine coolant water at a temperature above ambient temperature.

39. The pumpless water system of claim 38 which returns engine coolant for use into the body of water after one pass through the water system.

40. The pumpless water system of claim 39 which provides engine coolant water only when the engine is operating.

41. The pumpless water system of claim 40 in which the second supply of engine coolant is connected to the engine cooling system at a point which would allow a substantial portion of the coolant water to drain from the engine by gravity if opened.

42. The pumpless water system of claim 41 in which the second supply is connected to the engine cooling system at a engine cooling system drain port.

43. The pumpless water system of claim 41 which is the means for obtaining first supply of engine coolant water is capable of conveying a volume of water at least equal to a substantially ⅝" diameter hose.

44. The pumpless water system of claim 43 in which a first valve means is provided to control the flow of engine coolant in the second supply of engine coolant.

45. The pumpless water system of claim 44 in which a second valve means is provided to control the flow of engine coolant in the first supply of engine coolant.

46. The pumpless water system of claim 45 in which the first supply of engine coolant and second supply of engine coolant are mixed in a delivery means for supplying engine coolant to the user.

47. The pumpless water system of claim 46 in which a supply valve means is provided to control the flow of engine coolant in the delivery means.

48. The pumpless water system of claim 47 in which a shower head distribution means is provided at one end of the delivery means to distribute engine coolant to the user.

49. The pumpless water system of claim 48 in which a delivery disconnect means is provided for quickly disengaging the fittings between the shower head distribution means and the delivery means for quickly disconnecting the shower head distribution means from the delivery means.

50. The pumpless water system of claim 48 in which delivery disconnect means are provided for quickly disengaging the fittings between (1) the delivery means and (2) the first supply of engine coolant and the second supply of engine coolant for storage of the delivery means.

51. The pumpless water system of claim 49 in which a shower head valve means is supplied to regulate the flow of engine coolant to the user.

52. The pumpless water system of claim 51 in which a disconnect valve means is provided at each delivery disconnect means to regulate flow when the delivery disconnect means is disconnected.

* * * * *